US007811142B2

(12) United States Patent
Olenio

(10) Patent No.: US 7,811,142 B2
(45) Date of Patent: Oct. 12, 2010

(54) FITTING FOR CLEANING A THROUGH HULL PORT FROM INSIDE A MARINE VESSEL

(76) Inventor: Robert D. Olenio, 300 Salem St., North Andover, MA (US) 01845

( * ) Notice: Subject to any disclaimer, the term of this patent is extended or adjusted under 35 U.S.C. 154(b) by 1135 days.

(21) Appl. No.: 11/414,002

(22) Filed: Apr. 28, 2006

(65) Prior Publication Data

US 2009/0007833 A1 Jan. 8, 2009

Related U.S. Application Data

(60) Provisional application No. 60/675,696, filed on Apr. 28, 2005.

(51) Int. Cl.
*B63H 20/28* (2006.01)

(52) U.S. Cl. ..... 440/88 M

(58) Field of Classification Search ..... 440/88 M; 15/104.095

See application file for complete search history.

(56) References Cited

U.S. PATENT DOCUMENTS 1,278,882 A 9/1918 Donnell
3,309,167 A 3/1967 Galler
3,864,260 A 2/1975 Banner
4,061,571 A 12/1977 Banner
4,809,632 A 3/1989 Hamel
5,011,615 A 4/1991 Minderman
5,327,848 A 7/1994 Hannon, Jr.
5,368,748 A 11/1994 Sanderson
5,441,368 A 8/1995 Campbell et al.
6,004,175 A * 12/1999 McCoy ..... 440/88 R
6,009,823 A 1/2000 Gross
6,047,431 A * 4/2000 Canonica ..... 15/104.095
6,276,018 B1 * 8/2001 Leiman et al. ..... 15/104.19

* cited by examiner

*Primary Examiner*—Stephen Avila
(74) *Attorney, Agent, or Firm*—Edward L. Kelley; Invention Management Associates

(57) ABSTRACT

A marine through hull fitting (50) includes a cleanout housing (80, 204) attached thereto. The clean out housing (80, 204) is configured with a mechanical cleaning implement (94, 218) supported for movement through a first fluid conduit (59) that passes through a vessel hull (54) for scrapping debris from the side walls of the first fluid conduit when the conduit becomes fowled. The cleaning implement (94, 218) is attached to an actuator rod (92) which may be used to hand push the cleaning implement (94, 218) through the conduit (57).

22 Claims, 4 Drawing Sheets

FITTING FOR CLEANING A THROUGH HULL PORT FROM INSIDE A MARINE VESSEL

RELATED APPLICATIONS

This application relates to and claims the priority of provisional patent application Ser. No. 60/675,696, entitled METHOD AND APPARATUS FOR REMOVING CONTAMINATES FROM A THROUGH HULL PORT, filed on Apr. 28, 2005.

BACKGROUND OR THE INVENTION

The invention provides an apparatus and method for removing contaminates and living marine life from a marine vessel intake port while the vessel remains in the water and without the need to access the intake port from its inlet side. In particular, the invention provides a plunger element supported to be movable within an intake port to mechanically scrape debris from its internal walls when needed. The plunger element may be configured to be pushed through the intake port by hand, from inside the vessel, or to be pushed through the intake port by a powered mechanism.

Marine vessels use water to cool engines and for other purposes. The water is drawn into the vessel through intake ports, located below the vessel waterline, and pumped to various locations through out the vessel. Marine inboard engines may be cooled by water drawn onboard through submerged intake ports by pumps. The water may be pumped through heat exchange elements or various passages inside a marine engine to cool the engine, and then be discharged overboard through an output port. Marine outboard motors may also be cooled by water drawn into the motor through submerged intake ports by pumps. The water may be pumped through various passages inside the outboard motor to cool the motor and then be discharged overboard through outlet ports.

A typical marine engine or motor cooling system may include one or more submerged intake ports, various conduits for carrying the water to the areas of the engine or motor that need to be cooled, a heat exchange element or area for transferring thermal energy from the engine or motor to the circulating water, various conduits leading away from the heat exchange element or area and one or more exit ports for discharging the water from the vessel or outboard motor. The engine cooling system may also include various controls and feedback elements to circulate cooling water continuously or to circulate the water only when the engine needs to be cooled. Similar systems may also be used to cool other marine equipment, e.g. power generators that may need to be cooled.

It is a long standing problem that marine vessel water intake ports may draw unwanted debris into the cooling system and the unwanted debris may partially or completely block the intake of water. In addition, in salt water vessels, the cooling system may become contaminated with salt which contributes to pump wear and corrosion. Accordingly, marine cooling systems often require periodic cleaning to remove loose and lodged debris contained therein. The cleaning may be performed by flushing out the entire cooling system with fresh clean water, such as when the vessel is docked. For this reason, many marine water cooling systems are provided with a separate clean water intake port used to receive fresh clean water therein from a water supply. The clean water may be flushed through the cleaning system to remove unwanted debris. However, in many instances, flushing a marine cooling system with fresh clean water does not provide complete cleaning and further mechanical cleaning action may be required.

To keep engine cooling systems from sucking up unwanted debris, it is know to provide a course screen or other filter element over the water inlet side of the intake port. A course screen/filter element serves to prevent large debris such as sea weed or floating trash from being drawn in through the intake port. However, the screen/filter element does not prevent small contaminates from being drawn in to the cooling system and these small contaminates may include minute marine organisms such as tiny barnacles, mussels and other mollusks in the early stages of their life. These minute marine animals attach themselves to the walls of the various fluid conduits and heat exchange elements of the cooling systems and often remain there, growing larger over time. Eventually, live marine organisms grow large enough to begin to decrease the diameter of the conduits. Moreover, new marine organisms entering the cooling system attach to the other marine organisms already attached to the conduit walls to further reduce the diameter of the conduits. The resulting decrease in conduit diameter restricts the volume of water passing through the conduits thereby reducing engine cooling capacity. Ultimately, if left untreated the restricted flow leads to overheating in the engines.

In general, the problem of marine growth restricting water flow only occurs in the cooler areas of the marine cooling system since marine organism can not survive inside areas of the cooling system that are routinely heated to temperatures in excess of about 100 degrees Fahrenheit. Therefore the problem of continuous growth of marine organisms in a marine cooling system tends to be restricted to the intake port where the water always remains cool. However, in some instances the water exiting the vessel may have cooled enough by the time it reaches the exit port that continuous growth of marine organisms in an outlet port may also occur.

Until now, removing marine growth from vessel intake and exits ports has meant sending a diver into the water to mechanically scrap the fouled intake and exit ports clean, or pulling the vessel out of the water to scrape the fouled ports. In either case, the ports are cleaned from outside the vessel hull. In many small marine crafts these ports must be cleaned at least once per season and depending on local marine condition more than twice per season. There is a need in the art to provide an improved cleaning device and method for cleaning submerged water ports in marine vessels.

BRIEF SUMMARY OF THE INVENTION

The problems of the prior art are solved by providing a fitting suitable for attaching to a marine hull 54 and forming a port in the hull. The fitting 50 is configured for cleaning the port from inside the vessel. In particular the fitting includes a pipe section (56) formed by an annular outer wall (57) surrounding a first fluid conduit (59). The first fluid conduit extends along a first longitudinal flow axis (58) and includes a first open end (60) that forms the vessel port and an opposing second open end (62) inside the vessel hull. Generally the pipe section pass through the vessel hull and is configured to mechanically clamp to the hull and prevent water form leaking through the hull, except to enter the first fluid conduit.

The fitting 50 includes a cleanout housing (80) formed by outer wall sections (82, 204) for surrounding a second fluid conduit (64, 206). The second fluid conduit has a longitudinal axis that may be coaxial with the first longitudinal axis (58) or may be orthogonal to the first longitudinal axis. The outer wall sections (82, 204) includes a first port aperture (81, 224)

passing therethrough for fluidly connecting with the pipe section at its second open end (62) and exchanging fluid with the pipe section 56. The outer wall sections (82, 204) also include a second port aperture (90, 224) used to connect to another fluid conduit, e.g. the conduits 28 and 36 in FIG. 1.

The fitting 50 includes a cleanout plunger assembly attached to the outer housing (82, 204). The cleanout plunger assembly includes a cleaning implement (94) installed inside the cleanout housing (82, 204) and attached to an actuator element (92) such as a cylindrical steel rod. The rod extends outside the cleanout housing (82, 204) and is movable with respect to the cleanout housing (82, 204) for moving the cleaning implement (94) along the first longitudinal flow axis (58) and through the fluid conduit (59) for mechanically cleaning debris therefrom.

The cleaning implement (94) may comprise a rigid disk-shaped scraper formed with a disk diameter that is slightly less than a diameter of the fluid conduit (59).

The scrapped is pushed through the first fluid conduit to scrap any debris from its walls. The cleaning implement (94) may also comprise a semi-rigid or flexible scraper. In one example the cleaning end of the rod may include steel wire strands extending radially out from the rod axial center for contacting the inside diameter wall of the fluid conduit. In this case the radial length of the wire strands exceeds the radius of the fluid conduit such that the wire strands are bent to conform to the shape of the conduit as the rod cleaning end is forced into engagement with the fluid conduit.

In further embodiments movement of the actuator element may be mechanized and the actuator element may be moved longitudinally and rotated about its longitudinal axis to improve cleaning action.

BRIEF DESCRIPTION OF THE DRAWINGS

The features of the present invention will best be understood from a detailed description of the invention and a preferred embodiment thereof selected for the purposes of illustration and shown in the accompanying drawing in which.

DETAILED DESCRIPTION OF THE INVENTION

Figure 1:
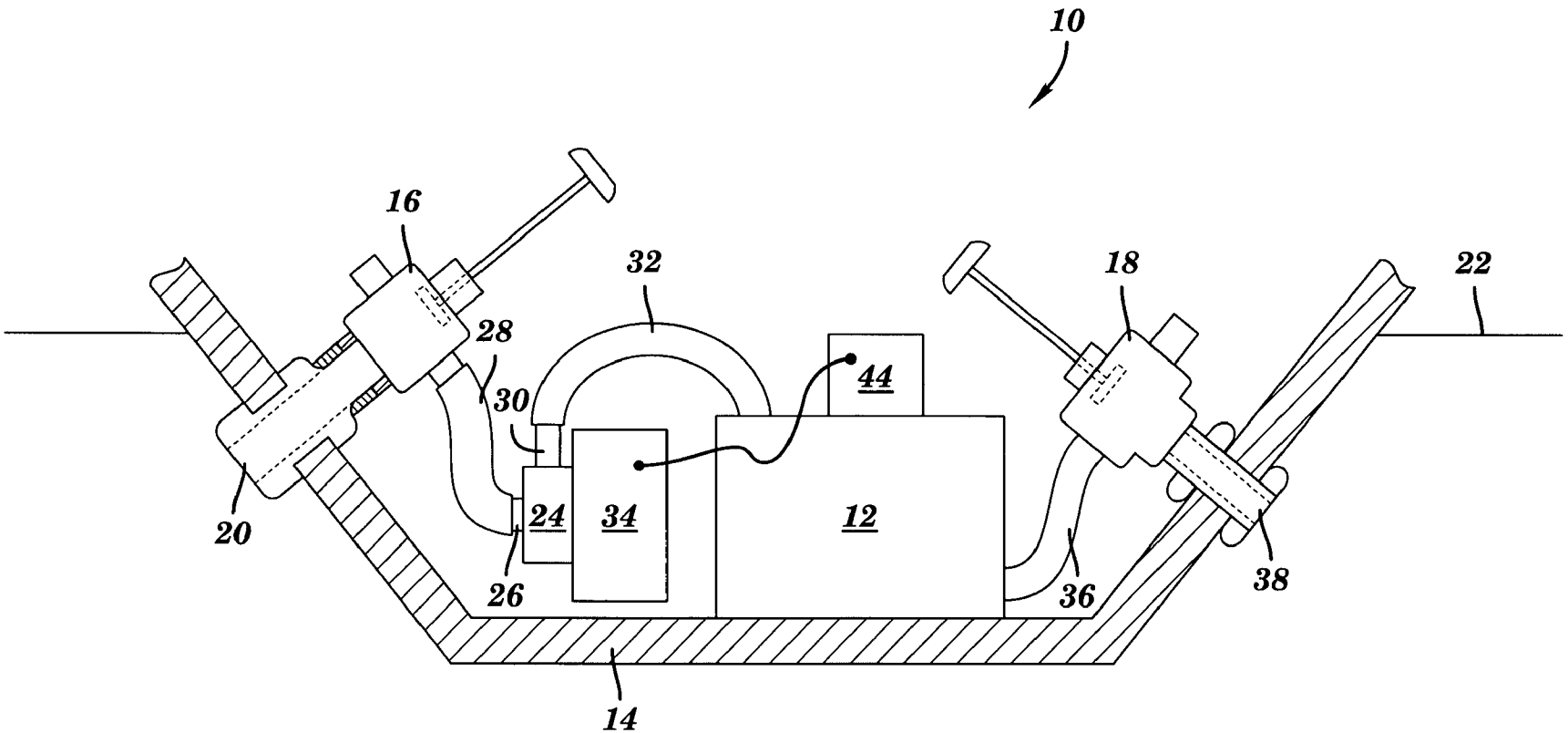
FIG. 1 illustrates a schematic representation of one example of a marine engine cooling system according to the present invention.

FIG. 1 depicts a schematic diagram of a cooling system 10 for cooling an inboard marine engine 12 according to the present invention. The cooling system 10 and marine engine 12 are installed inside a marine hull 14. The cooling system 10 utilizes a novel through hull fitting 16 on an intake side to draw water into the vessel through the hull 14. According to the present invention, the through hull fitting 16 is equipped with port cleaning mechanism, described below. A substantially similar through hull fitting 18 is usable on an outlet side to expel water out from the hull 14. According to a further aspect of the present invention, the through hull fitting 18 may also include a port cleaning mechanism.

The through hull fitting 16 include an intake port 20 disposed below a hull waterline 22 and passing through the hull 14. Water is drawn into and expelled out from the vessel by a circulating pump 24, such as a conventional impeller pump. The pump 24 includes an intake port 26, which is in fluid communication with the through hull fitting 16 via a first fluid conduit 28, e.g. a rubber or plastic hose. A pump outlet port 30 delivers water out from the pump 24 and is in fluid communication with the marine engine 12 via a second fluid conduit 32. A motive drive device 34, e.g. the marine engine or an electric motor, drives the pump 24. The motive drive device 34 may operate continuously providing a constant water flow rate or may operate intermittently or at various water flow rates in response to command signals received from cooling system controller 44. Generally, operation of the pump 24 draws water into the vessel through the intake port 20 via the first and second fluid conduits (28, 32) to the marine engine 12. The marine engine 12 receives cooling water therein and the cooling water flows through conventional engine water cooling channels and is expelled out therefrom to a third fluid conduit 36, e.g. a rubber hose. The third fluid conduit 36 connects to the through hull fitting 18 which expels water out from the hull through an outlet port 38. If the outlet port 38 is below the water line 22 the through hull fitting 18 may be equipped with a port cleaning mechanism as described below.

Figure 2:
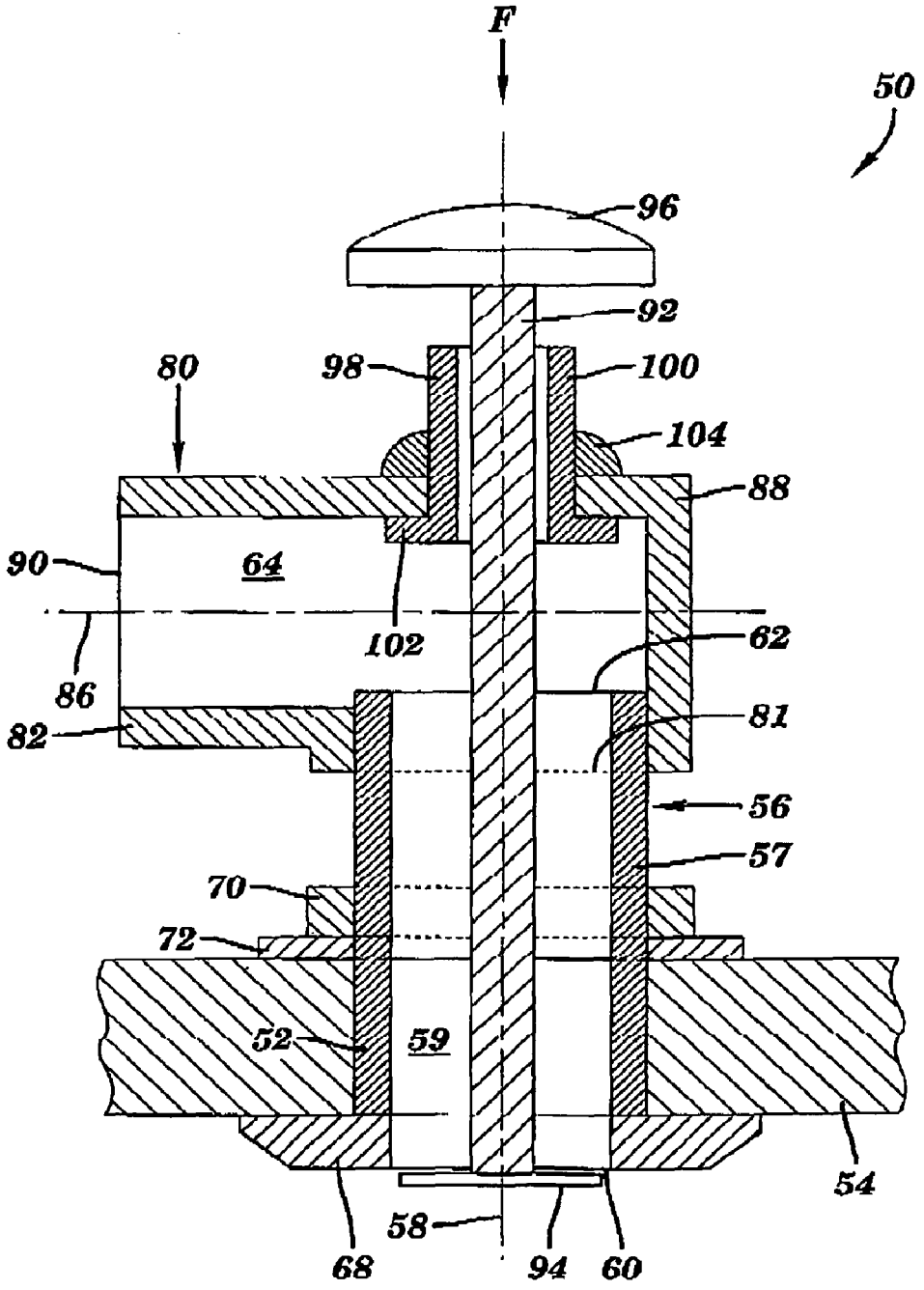
FIG. 2 illustrates section view taken through one embodiment of through hull fitting configured with a cleaning scrapper according to the present invention.

FIG. 2 depicts a first embodiment of a through hull fitting 50 equipped with a cleanout mechanism according to the present invention, shown in section view. The fitting 50 is usable as an intake through hull fitting or an outlet through hull fitting. Generally, the through hull fitting 50 passes through an aperture 52 extending through a vessel hull 54. The through hull fitting 50 comprises a pipe section 56, having an annular wall 57 surrounding a fluid conduit 59 extending along a longitudinal flow axis 58. In the example embodiment, the annular wall 57 is cylindrical with an externally threaded outside diameter and a smooth walled inside diameter surface. The pipe section 56 is open at each end thereof. A first open end is disposed external to the hull 54 as a port 60 usable as an intake or outlet port. A second open end 62 attaches to a cleanout housing 80 and delivers water into a second fluid conduit 64 formed within a cleanout housing 80 and extending along a second longitudinal axis 86.

The pipe section 56 is formed with an annular shoulder portion 68 positioned proximate to the port 60 for contacting an outside surface of the hull 54. The annular shoulder portion 68 may comprise a removable nut that is internally threaded to engage with the external threads of the pipe section 56, or the shoulder may be otherwise removably attached to the pipe section 56. Alternately, the annular shoulder 68 may be fixedly attached to the pipe section, e.g. by welding, or the shoulder 68 may be integrally formed with the pipe section 56, e.g. as an integral casting or machined element.

The annular shoulder 68 is opposed by a compression nut 70 disposed inside the hull 54 and threadedly engaged with the external threads of the pipe section 56. The compression nut 70 includes an annular shoulder 72 used to seat against an inside surface of the hull 54 and to substantially oppose the annular shoulder 68 such that when the compression nut 70 is tightened, the pipe section 56 clamps to the hull 54, between the opposing annular shoulders 68 and 72, and is rigidly supported with respect thereto. In addition, water sealing gaskets or a water sealing compound may be applied along surfaces of the annular shoulders 68 and 72 and to surfaces of the pipe section 56 to form a water tight seal around hull aperture 52. Generally, the pipe section 56 may comprise a conventional externally threaded nipple having a smooth walled internal diameter and the compression nut 70 may be a conventional compression nut. Preferably, the compression nut 70, pipe section 56 and annular shoulder 68 are each formed from materials suitable for marine applications such as brass, bronze, stainless steel, plastic pipe e.g. poly vinyl chloride, (PVC) or other non-corrosive material that can be suitably adapted as described.

The cleanout housing 80 comprises an outer wall 82 for surrounding the fluid conduit 64. The outer wall 80 includes a first port aperture 81 extending therethrough for attaching to the pipe section 56 and exchanging water therewith. In the example embodiment, the first port aperture 81 is internally threaded for engagement with the externally threaded annular wall 57. The fluid conduit 64 is closed at one end by an end wall 88 and includes a second port aperture 90 opposed to the end wall 88. The second port aperture 90 is configured to interface with another fluid conduit to exchange fluid therewith. In the example of FIG. 1, the second port aperture 90 interfaces with the first fluid conduit 28 leading to the intake side of the pump 24 such that operation of the pump 24 draws water from outside the hull, through the pipe section 56, into the cleanout housing conduit 64 and out the second port aperture 90 in a continuous flow.

According to one embodiment of the present invention, a clean out plunger assembly is attached to the clean out housing 80 for cleaning out the pipe section 56. The plunger assembly comprises a cylindrical rod 92 moveably disposed within a rod support bushing 98. According to the invention, a first end of the rod 92 is disposed inside the clean out housing 80 and a second end of the rod 92 disposed outside the clean out housing 80. The rod first end is equipped with a cleaning implement 94 attached thereto and disposed inside the cleanout housing 80. The rod second end is equipped with a handle 96 and disposed outside the cleanout housing 80.

Under normal operating conditions of the engine cooling system 10, the rod 92 is locked or detented at a parked position with the cleaning implement 94 positioned inside the cleanout housing 80 in the fluid conduit 64. In the parked position, most of the rod length extends outside the cleanout housing 80. During non-operating times of the of the engine cooling system 10, the rod 92 is occasionally used to clean debris from the inside diameter wall of the pipe section 56. This is accomplished by an operator who applies pushing force against the handle 96 to advance the rod 92 and the attached cleaning implement 94 through the fluid conduit 64 and into engagement with the inside diameter wall of the pipe section 56. As will be described below, the cleaning implement 94 is configured to scrap or otherwise mechanically remove debris from the inside diameter of the pipe section 56. Preferably, the rod 92 is long enough to push the cleaning implement 94 through the port 60 for expelling the debris removed from the inside walls out of the vessel. In addition, the rod 92 may be locked or detented in a second position which supports the cleaning implement 94 substantially engaged with the inside diameter of the pipe section 56 for blocking or sealing the port 60 as may be required.

The rod 92 is supported by a rod support bushing 98. The bushing 98 comprises a tube portion 100 comprising an annular wall formed around an axial bore extending along its longitudinal length for receiving the rod 92 therein. The axial bore closely fits the rod diameter to support the rod 92 and guide its movement along the rod longitudinal axis 58. The tube portion 100 may be formed with an externally threaded outside diameter. The axial bore may be configured as a continuous smooth uniform inside diameter for contacting the rod 92 along its full length, or the axial bore may be configured with a stepped inside diameter lands formed as spaced apart bearing surfaces for contacting the rod 92. Preferably, the length of tube portion 106 and the axial bore are suitable for guiding movement of the rod without play or jamming.

The rod support bushing 98 includes an annular shoulder 102 or other engaging feature disposed inside the conduit 64 for contacting an inside surface of the cleanout housing 80. The annular shoulder 102 may be fixedly attached to the tube section 106 or formed integral therewith. An internally threaded bushing nut 104 engages with the external threads of the tube section 106 external to the cleanout housing 80 and opposed to the annular shoulder 102 for clamping the rod support bushing 98 to the cleanout housing 80. In addition, gaskets, sealing elements and or sealing compounds may be applied to surfaces of the rod 92, the rod support busing 98 and the bushing nut 104 to form a water tight seal around the rod support bushing 98 and the rod 92.

The cleaning implement 94 may comprise a disk shaped scrapper with a disk diameter that is slightly smaller than the internal diameter of the pipe section 56 and port 60. The disk shaped scrapper 94 is centered on the first end of the rod 92 such that a downward longitudinal force F applied to the rod handle 96 by hand advances the disk shaped scrapper 94 from its parked position, substantially in contact with the support bushing annular shoulder 102, and into engagement with the internal diameter of the pipe section 54. In further response to the force F, the disk shaped scraper scraps debris from the inside diameter pipe section 56 and forces the debris out of the vessel through the port 60. After the cleaning is completed, the rod handle may be hand pulled upward and retuned to the park position. Alternately, the rod 92 may be locked or detented in its second position which leaves the disk shaped scraper engaged within the inside diameter of the pipe section 56 for blocking or sealing the port 60 as may be required.

Figure 3:
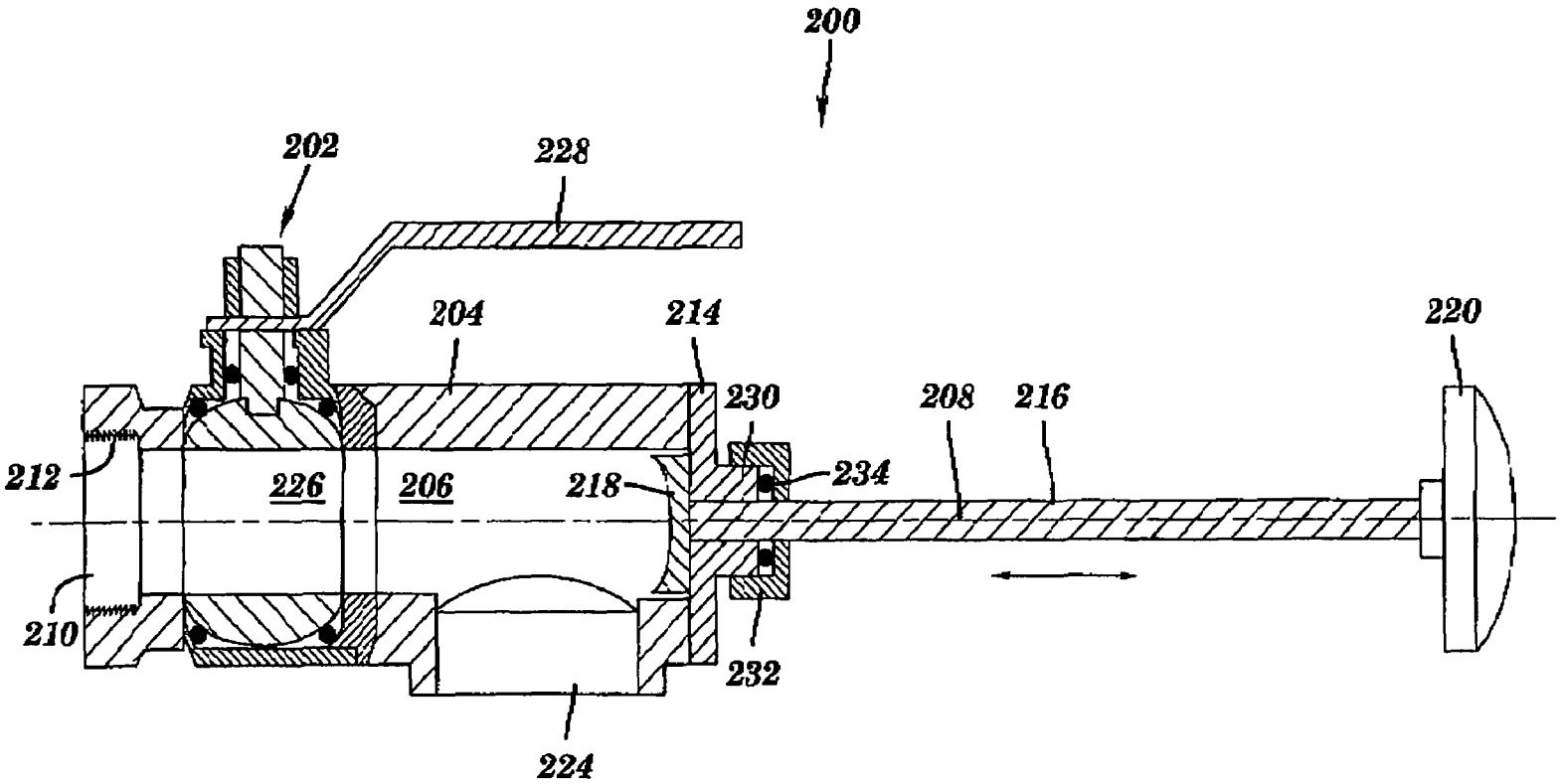
FIG. 3 illustrates section view taken through one embodiment of a clean out housing incorporating a ball valve according to the present invention.

FIG. 3 depicts an alternate embodiment of a clean out housing 200 that includes a ball valve 202. The housing 200 includes a cylindrical outer wall 204 having a cylindrical conduit 206 formed therein with a longitudinal axis 208. The conduit 206 has an open end 210 configured with internal threads 212 to engage with a pipe section such as the pipe section 56 described above. Specifically, the cleanout housing 200 engages with a pipe section 56, which includes a port 60, a compression nut 70, and annular shoulder 72 for engaging with a vessel hull 54, all as described above and as shown in detail in FIG. 2. The conduit 206 further includes a closed end formed by an end wall 214 disposed opposed to the open end 210. The end wall 214 is configured with a clean out plunger assembly including a rod 216 configured with a disk shaped scrapper 218 disposed inside the conduit 206 and a handle 220 disposed external to the conduit 206. In this embodiment, the end wall 214 attaches to the cylindrical outer wall 204 and may include a rod bushing hub 230 formed integral therewith for receiving the rod 216 through a rod support diameter extending through the rod bushing hub 230. In addition, a bushing nut 232 is threadedly engaged with the bushing hub 230 and a fluid seal 234 is captured between the bushing hub 230 and nut 232 for sealing the rod interface with the conduit 206. Generally the busing hub 230 includes a through bore for moveably receiving the rod 216 therein and for supporting the rod 216 with respect to the housing 200.

In addition, the housing 200 includes an exit port 224. The exit port 224 may be internally threaded for attaching to a fluid conduit, e.g. 28 or 38 shown in FIG. 1. Specifically the exit port 224 may include a hose fitting engaged therein to equip the clean out housing 200 to connect with a hose or other fluid conduit. In addition, the clean out housing 200 may also include a valve assembly 202 for opening or closing the fluid conduit 206 as may be required. In the example embodiment, a ball valve 202 is shown in an open position and in the open position provides a passage 226 through the valve housing. The passage 226 is cylindrical has an inside diameter that is larger than the disk shaped clean out element 218 such that the clean out element passes through the passage 226. The ball valve 202 may be closed position by turning a valve handle 228 to rotate a ball portion for rotating the passage 266 to another orientation and thereby block the conduit 206 and prevent water from flowing therethrough.

The cleanout housing 200 is equipped with a disk shaped scrapper 218 attached to the rod 216 and disposed inside the conduit 206. A handle 220 attaches to the rod 216 outside the housing 200. As is described above, the cylindrical conduit 206, passage 226 and attached pipe section 56, not shown, may be scraped clean of debris by hand pushing the rod handle 202 to advance the scrapper 218 through the internal passages of the clean out housing 210, the valve 202 and the pipe section 56 and the debris may be pushed out of the vessel through the port 60 at the end of the pipe section 56.

In another embodiment of the present invention, movement of the cleanout rod may be mechanized. Specifically, the clean out device of the present invention may be further equipped with a mechanical. electrical. pneumatic or hydraulic actuator means configured to apply a longitudinal force to the rod (92) for advancing the rod (92) in either direction along its longitudinal axis.

Figure 4:
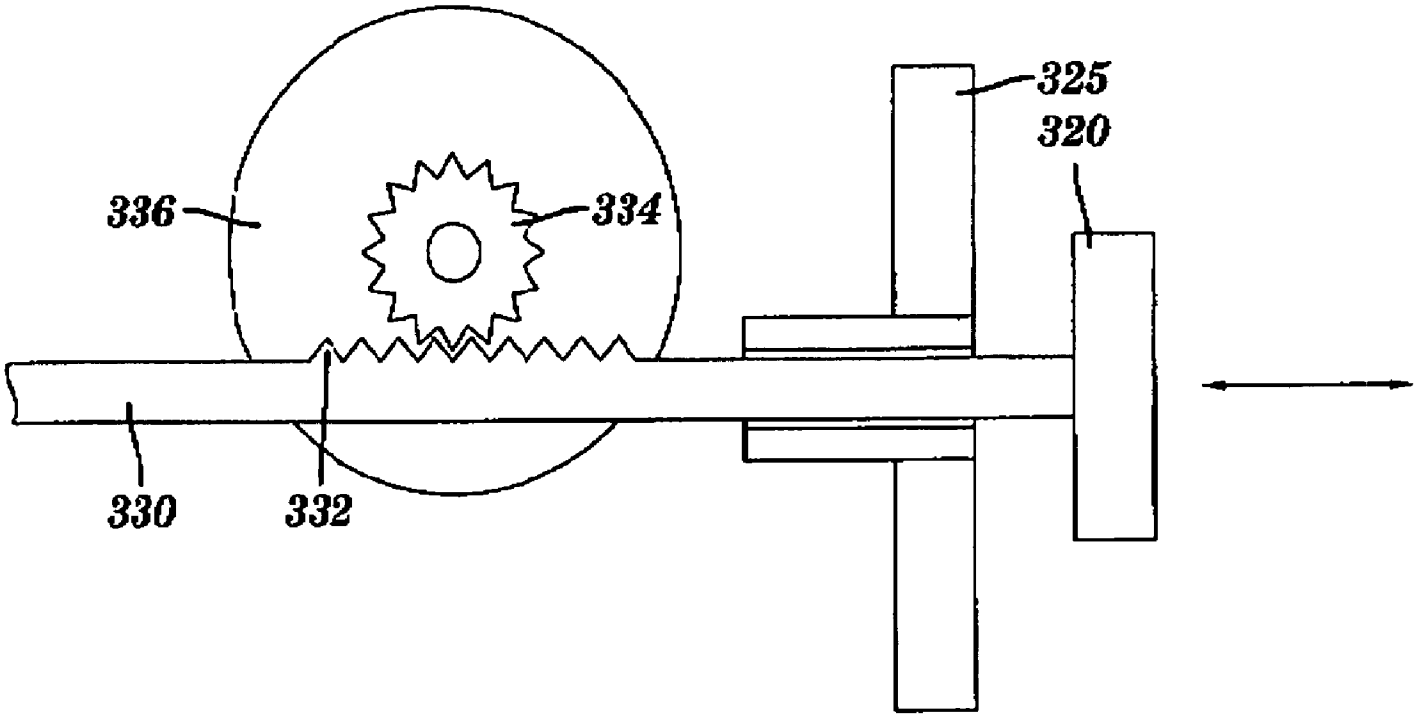
FIG. 4 illustrates one example of a mechanized actuator for moving the scrapper through the through hull fitting.

In FIG. 4 one example of a mechanized a rod 330 is shown with rack style gear teeth 332 formed on a rod 330 to engage with a pinion gear 334. The rod includes a cleaning implement 320 attached to an end thereof a rod bushing and fitting external housing are generally shown by the reference numeral 325. An electrical motor 336 may be used to rotate the pinion gear 334 in response to a clean out command received from a controller or a manual switch, not shown. In response to the command, the pinion gear 334 is rotated by the electrical motor 336. The rotation of the pinion gear 334 acts on the rod teeth 332 to advance the rod 330 along its longitudinal axis. The direction of rod movement is dependent upon the direction of rotation of the electric motor 336, which may be rotated in both directions. Accordingly, the rod 330 may be advanced to the right for cleaning a conduit and to the left for removal from the conduit.

In other mechanized embodiments, the rod 330 may be engaged with opposing pneumatic or hydraulic piston actuators with one actuator advancing the rod to the right for cleaning a conduit and another advancing the rod to the left for removable from the conduit. In yet another mechanized embodiment opposing electrical solenoids are usable in a similar arrangement. In yet another mechanized embodiment, a single mechanized actuator, e.g. an electrical solenoid can be use to advance rod to the right for cleaning a conduit and a mechanical or fluid spring can be disposed to advance the rod to the left when the cleaning operation is finished.

In further embodiments various cleaning device may be attached to the rod 92. In the above examples the cleaning device is a rigid disk shaped scraper formed with an outside diameter that is less than the inside diameter of the fluid conduit to be cleaned. Moreover, the only force applied to the rod 92 is a longitudinal force. In a further embodiment of the present invention the cleaning implement 94 attached to the rod 92 may comprise a deformable element such as a wire brush or deformable disk. Moreover, the diameter of the deformable element may exceed the inside diameter of the conduit being cleaned. In addition, a combined longitudinal and rotational force may be applied to the external end of the rod 92 for generating additional cleaning action in the conduit. In addition, the cleaning implement 94 may comprise a combination of rigid and deformable elements.

It will also be recognized by those skilled in the art that, while the invention has been described above in terms of preferred embodiments, it is not limited thereto.

Various features and aspects of the above described invention may be used individually or jointly. Further, although the invention has been described in the context of its implementation in a particular environment, and for particular applications, e.g. for a marine craft with an inboard engine, those skilled in the art will recognize that its usefulness is not limited thereto and that the present invention can be beneficially utilized in any number of environments and implementations including but not limited to any water or fluid intake port where its internal walls may become contaminated by debris that needs to be periodically scrapped off. Accordingly, the claims set forth below should be construed in view of the full breadth and spirit of the invention as disclosed herein.

The invention claimed is:

1. A fitting configured for cleaning a first fluid conduit comprising:

a first annular outer wall surrounding the first fluid conduit which extends along a first longitudinal flow axis and includes a first open end and an opposing second open end;

a cleanout housing surrounding a second fluid conduit, formed with a first port aperture passing through the cleanout housing and attached to the first annular outer wall at the second open end for fluidly connecting the second fluid conduit with the first fluid conduit, and a second port aperture passing through the cleanout housing;

a cleaning implement installed inside the cleanout housing opposed to the first port aperture; and, an actuator element fixedly attached to the cleaning implement and movably passing through the cleanout housing opposed to the first port aperture for advancing the cleaning implement along the first longitudinal flow axis into engagement with the first port aperture and substantially through the first fluid conduit for mechanically cleaning debris therefrom.

2. The fitting of claim 1 wherein the actuator element comprises a cylindrical rod and the cleaning implement comprises a rigid disk-shaped scraper having a disk diameter that is slightly less than an inside diameter of the first fluid conduit.

3. The fitting of claim 1 wherein the actuator element comprises a cylindrical rod and the cleaning implement comprises a deformable element extending radially from the cylindrical rod and having a diameter that is greater than an inside diameter of the first fluid conduit.

4. The fitting of claim 1 wherein the actuator element comprises a cylindrical rod, further comprising a rod support bushing formed by an annular wall surrounding an axial bore wherein the annular wall is fixedly attached to the cleanout housing and the axial bore extends through the cleanout housing to the second fluid conduit opposed to the first port aperture for movably receiving the cylindrical rod through the axial bore.

5. The fitting of claim 1 further comprising a valve assembly disposed to selectively open and close the second fluid conduit.

6. The fitting of claim 1 wherein the first annular outer wall is configured to attach to and pass through a marine vessel hull with the first open end disposed substantially external to the hull.

7. The fitting of claim 1 wherein the second fluid conduit is disposed along a second longitudinal axis that is substantially orthogonal to the first longitudinal axis.

8. The fitting of claim 1 wherein the second fluid conduit is disposed substantially along the first longitudinal axis.

9. The fitting of claim 1 further comprising a handle attached to the actuator clement external to the cleanout housing.

10. The fitting of claim 1 further comprising a mechanized actuator disposed external to the cleanout housing and configured to apply a longitudinal force to the actuator element for advancing the actuator element in two directions along the first longitudinal axis.

11. A method for cleaning a hull port from inside a marine vessel comprising the steps of:

attaching a cleanout housing to the hull port;

configuring the cleanout housing with a cleanout plunger assembly comprising a cleaning implement installed in a parked position inside the cleanout housing and an actuator element having a first end fixedly attached to the cleaning implement and a second end that extends outside the cleanout housing wherein the actuator element is supported for movably passing through the cleanout housing issuing a cleanout command to apply a first actuator force to the actuator element wherein the first actuator force advances the cleaning implement into engagement with and through the hull port to mechanically remove debris from an inside wall of the hull port; and, applying a second actuator force to the actuator element opposed to the first actuator force, to return the cleaning implement to the parked position.

12. The method of claim 11 wherein the step of applying the first actuator force comprises operating a first mechanized device disposed outside the cleanout housing to advance the actuator element second end an act along a longitudinal axis of the hull port.

13. The method of claim 12 wherein the step of applying the second actuator force comprises operating one of the first mechanized device disposed outside the cleanout housing and a second mechanized device disposed outside the cleanout housing to return the cleaning implement to the parked position.

14. The method of claim 12 wherein the step of applying the second actuator force comprises applying a spring force to return the cleaning implement to the parked position.

15. A cleanout housing attached to a first fluid conduit disposed along a first longitudinal axis comprising:

outer housing walls enclosing a second fluid conduit wherein the second fluid conduit is disposed along one of the first longitudinal axis and a second longitudinal axis;

a first port aperture passing through the outer housing walls for fluidly connecting the second fluid conduit with the first fluid conduit;

a second port aperture passing through the outer housing walls for fluidly connecting the second fluid conduit with another fluid conduit;

wherein the outer walls proximate to the first port aperture are configured to mechanically attach to and fluidly interconnect with the first fluid conduit and the outer walls proximate to the second port aperture are configured to mechanically attach to and fluidly interconnect with the another fluid conduit;

wherein the outer housing walls form a closed end wall opposed to one of the first port aperture and the second port aperture;

a cleaning implement installed inside the cleanout housing opposed to the first port aperture; and, an actuator clement fixedly attaching to the cleaning implement and movably passing through the outer walls for advancing the cleaning implement through the first port aperture to engage with and mechanically clean debris from the first fluid conduitone.

16. The cleanout housing of claim 15 wherein the actuator element comprises a cylindrical rod passing through a rod support bushing wherein the rod support bushing is fixedly attached to the outer housing walls and the rod support bushing comprises an axial bore passing through an annular wall formed around the axial bore for movably receiving the cylindrical rod through the axial bore.

17. The cleanout housing of claim 15 further comprising a valve assembly disposed to open and close the second fluid conduit.

18. The cleanout housing of claim 15 wherein the closed end wall is opposed to the first port aperture and the actuator element movably passes through the closed end to advance the cleaning implement along the first longitudinal axis to mechanically clean debris from the first fluid conduit.

19. The cleanout housing of claim 18 further comprising a valve assembly disposed between the closed end wall and the first port aperture and wherein the cleaning implement and the valve assembly are configured for the cleaning implement to pass through the valve assembly when the valve assembly is in an open position.

20. The cleanout housing of claim 15 wherein the first fluid conduit is disposed to pass through a marine vessel hull and the cleaning implement and actuator element are configured to push debris cleaned from the first fluid conduit out of the vessel.

21. The cleanout housing of claim 15 wherein the closed end is opposed to the second port aperture and the actuator clement movably passes through the outer walls opposed to the first port aperture and the actuator element and cleaning implement are advanced along the first longitudinal axis to mechanically clean debris from the first fluid conduit.

22. The cleanout housing of claim 21 wherein the first fluid conduit is disposed to pass through a marine vessel hull and the cleaning implement and actuator element are configured to push debris cleaned from the first fluid conduit out of the vessel.

* * * * *